United States Patent [19]

Longrod

[11] 4,269,521

[45] May 26, 1981

[54] KEY MECHANISM HAVING A SNAP ACTION

[75] Inventor: Scott J. Longrod, Danbury, Conn.

[73] Assignee: SCM Corporation, New York, N.Y.

[21] Appl. No.: 950,482

[22] Filed: Oct. 11, 1978

[51] Int. Cl.[3] ..... B41J 5/08

[52] U.S. Cl. ..... 400/472; 400/434.2; 400/496; 74/97; 200/67 F

[58] Field of Search ..... 173/100; 200/67 F, 62, 200/73, 74, 340; 251/65; 74/97, 100 R, 100 P; 400/472, 477, 479, 479.2, 440.2, 496, 434.2, 694

[56] References Cited

U.S. PATENT DOCUMENTS

| | | | |
|---|---|---|---|
| 403,288 | 5/1889 | Richards | 400/156.3 |
| 450,324 | 4/1891 | Yost et al. | 400/400.2 X |
| 2,444,529 | 7/1948 | Puster | 74/100 P X |
| 2,518,480 | 8/1950 | Lilja | 200/67 F |
| 2,646,478 | 7/1953 | Euler et al. | 200/73 X |
| 2,700,079 | 1/1955 | Haydon | 74/97 X |
| 3,302,877 | 2/1967 | Stuiber et al. | 400/495.1 |
| 3,612,240 | 10/1971 | Parker | 400/477 |
| 3,725,908 | 4/1973 | Brisebarre et al. | 340/365 A |
| 3,789,970 | 2/1974 | Costa | 400/480 |
| 3,915,277 | 10/1975 | Cappotto et al. | 400/368 |
| 3,964,593 | 6/1976 | Pointon | 400/491.3 |
| 4,055,734 | 10/1977 | Hayden | 200/340 X |
| 4,188,137 | 2/1980 | Dannatt | 400/440.2 X |

FOREIGN PATENT DOCUMENTS

| | | | |
|---|---|---|---|
| 1028059 | 5/1966 | United Kingdom | 400/496 |

*Primary Examiner*—Clifford D. Crowder

*Attorney, Agent, or Firm*—William E. Mear, III; Milton M. Wolson; Ernest F. Weinberger

[57] ABSTRACT

A key mechanism arrangement for use in a keyboard of a business machine wherein a snap motion occurs in response to depression of a keylever. An elongated resilient member is pivotally supported intermediate its ends on a member. One end of the resilient member is coupled to the keylever for bias support thereof, while the free end cooperates with a restraining means, to first prevent its movement during initial keylever depression to store energy and then quickly released, causing the free end to snap against a member of a utilization apparatus. The resilient member restores the key mechanism arrangement to a rest position upon release of the keylever. Four embodiments are disclosed all having the same mode of operation. In three of the embodiments the restraining means includes a means of latching the free end of the resilient member and then selectively releasing that end actuated by further depression of the keylever. In the fourth embodiment the free end of the resilient member is held by a magnet until the accumulation of energy is sufficient to overcome the magnetic force. Structure is provided on the keylever for uniquely coupling one end of the resilient member to the keylever for movement therewith.

53 Claims, 11 Drawing Figures

FORCE
F
0
DISPLACEMENT
D
FULL DEPRESSION
100
102
104
106
LOGIC
96
A
A

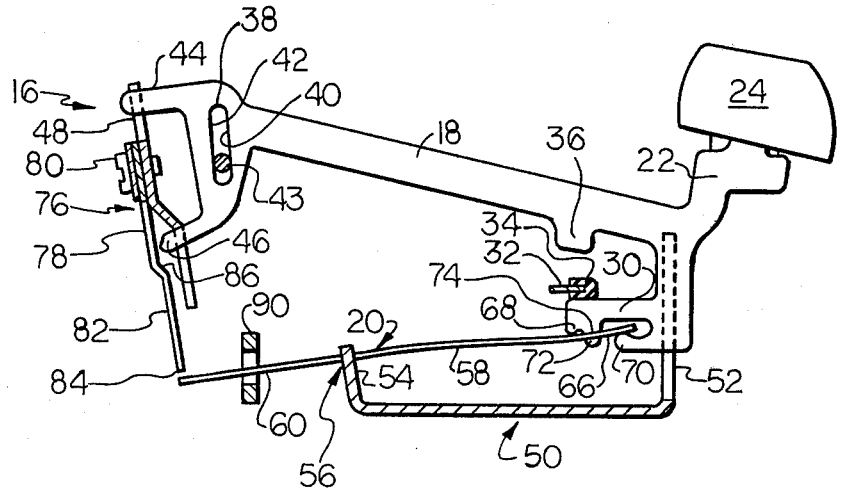
FIG 2 A-A
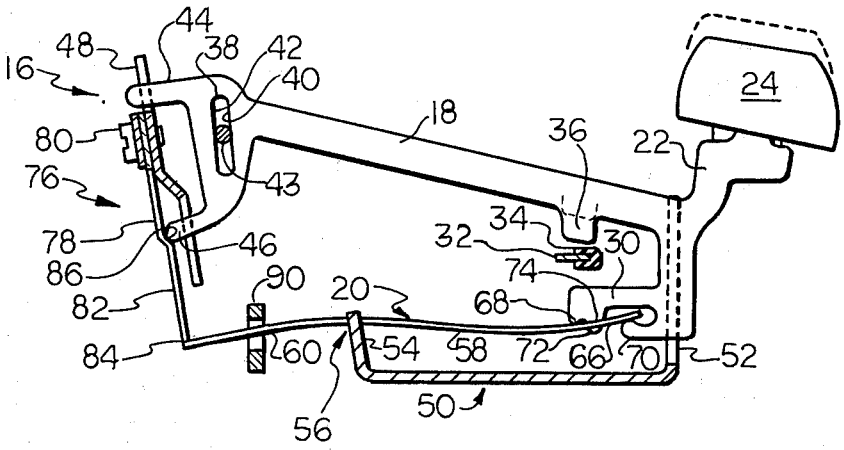
FIG 3
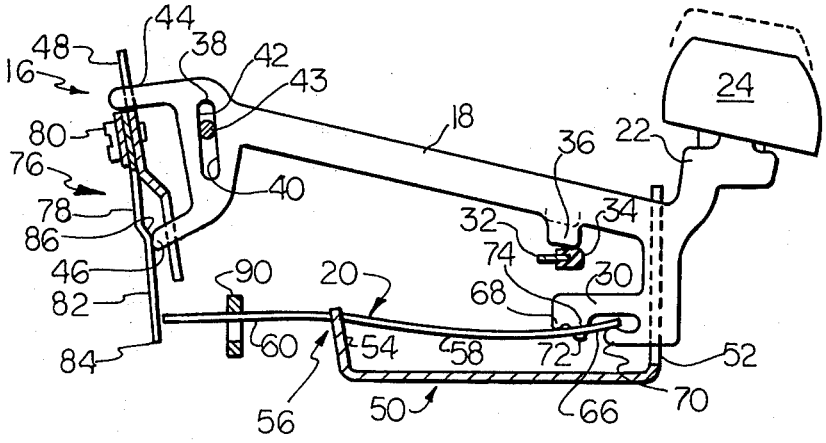
FIG 4

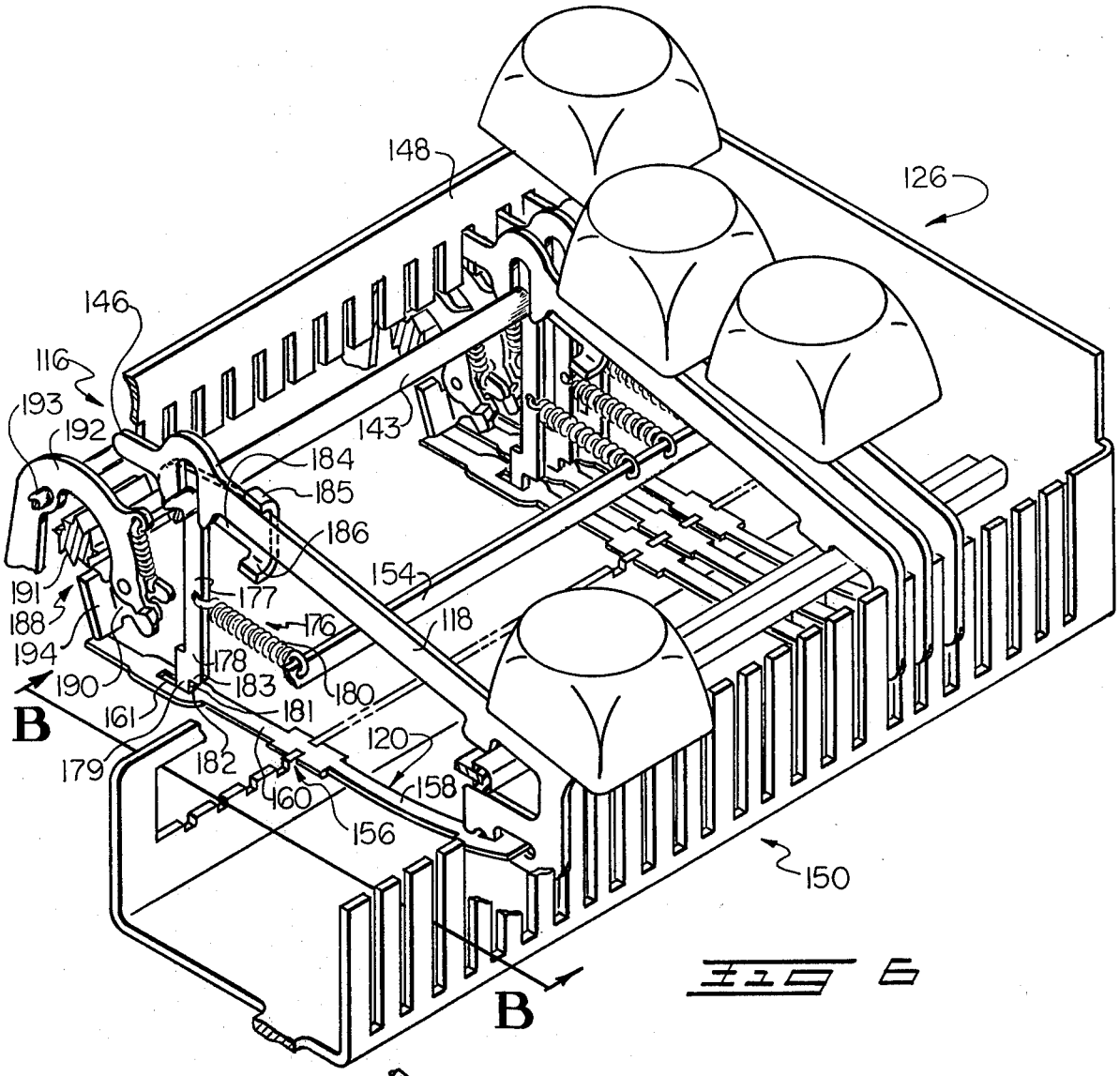
FIG 6
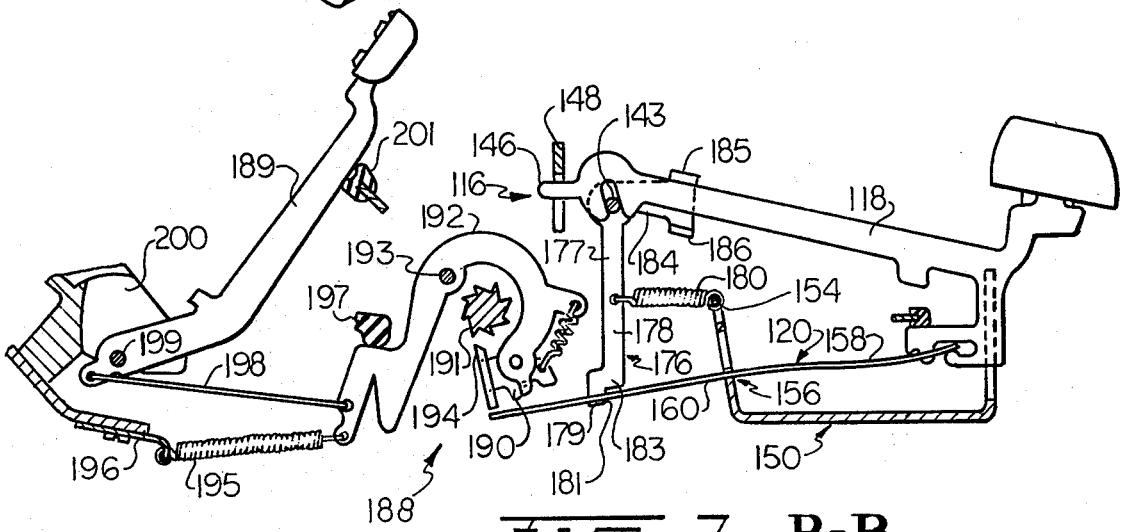
FIG 7 B-B

C-C

D-D

KEY MECHANISM HAVING A SNAP ACTION

BACKGROUND OF THE INVENTION

The present invention relates to key mechanisms for use in business machines such as typewriters, teletypewriters, calculators, adding machines, cash registers, etc. and equipment such as computer inputs, keyboard modules, and the like. More particularly it relates to key mechanism arrangements for use in keyboards to provide a snap action by a member corresponding to a selected key for initiating remote function.

Key mechanisms used in a keyboard of a modern business machine or equipment must be designed to satisfy increasing demands placed upon such machines. To achieve this, key mechanisms must be rapid in response and reliable in operation without sacrifice of economical manufacture to be widely acceptable. There is a need for versatile key mechanisms that are adaptable for a variety of keyboard usages; for example, in connection with machines operably controlled by either electronics or mechanical mechanisms. A most important design consideration for key mechanisms is its "touch" or "feel". A desirable approach is to provide a mechanism having a "tactile touch", that is to say, a key device operation that offers a certain resistance followed by a breakaway feeling usually caused by sudden removal of resistance felt by the operator. This provides the user with an effective pleasant sense of successful actuation of a selected key. Key mechanisms used in modular keyboards have many advantages including versatility in their use with many different types of machines without significant alterations in design. Additionally, should repair be required, a replacement keyboard may be employed thus minimizing machine shut-down time.

Key mechanism arrangements for keyboards as disclosed in the prior art include disadvantages. For example, U.S. Pat. No. 3,612,240 granted to R. L. Parker, discloses a key mechanism having pivoting keylevers with an element pivotally mounted and spring biased on one side of each keylever. A pin is fixed on each element and is cooperable with a deflector bar for controlling the actuation of the element upon depression of the keylever to a desired level. The element is then released and under the influence of the spring is caused to swing. The swing motion of the element is used to initiate remote devices corresponding to the selected keylever.

The Parker patent is an improved key mechanism, in that it is versatile in its use as shown and described in connection with the different disclosed embodiments. However, such versatility has a major disadvantage in that when applied to the different embodiments, a unique element is required. Moreover, for three of the disclosed embodiments the element must be differently constructed for use with each keylever, requiring an extensive costly part inventory for the manufacturer as well as complicating part replacement. The construction has another disadvantage in that the deflector bar which is critical for operation is elongated to effect all the elements and includes, for each element, teeth, each with an angular face and a cam notch construction. Such part complexities are difficult to produce requiring costly manufacturing processes as well as elaborate inspection techniques. Additionally, the deflector bar is subjected to frictional wear which after extended use may become inoperative requiring part replacement that is time consuming and difficult. Further, since this mechanism includes many frictional sliding part arrangements, lubrication is an important factor for reliability and quick response during operation. Such lubrication must be applied with skill, as too little is ineffective and too much attracts foreign particals such as dust and erasure droplets which may cause malfunction of the mechanism or require the addition of a costly insert cover. Further, the Parker patent does not disclose any mechanism for a desired key touch feature.

A prior art patent U.S. Pat. No. 403,288 issued to F. H. Richards, is an example of a simple mechanical movement initiated by key depression. This patent discloses a pivotal hammer for disengaging a hook upon depression of a key. The hammer is centrally pivoted having a rigid handle extending toward resting engagement with a stem of the key. The other end of the hammer is flexible about an abutment stop and has a hammer head at its end. A pair of springs are needed to restore the mechanism after actuation. Depression of the key causes the hammer to pivot, limited by the flexible end contacting the stop, however, momentum causes the hammer head to continue an amount sufficient to strike the hook. In this embodiment, as stated in the description, "the key should be forcibly struck" which is most unfavorable. The resulting movement of the fingers of the operator is suddenly stopped, thereby causing operator fatigue, and even possible injury to the finger tips. An improved second embodiment of the mechanical motion is disclosed wherein a detent is provided for momentarily preventing hammer movement until a spring has built up sufficient compression to overcome the detent.

The Richards patent has a disadvantage in construction due to several inherent part complexities. The hammer has a multitude of differently shaped sections, making such a part inconceivable to manufacture economically (at a high volume rate). Further, each key is closely contained in a housing for controlled vertical movement requiring costly manufacturing processes in obtaining satisfactory part relationship. The Richards patent does not provide a means for a desirable key touch, conversely, as mentioned, the mechanism is most cumbersome to use. For these reasons the mechanism of the Richards patent is not readily adaptable for the high volume requirements of modern manufacuters.

SUMMARY OF THE INVENTION

To overcome the problems of the prior art, the present invention sets forth a simple key mechanism arrangement in which a mechanical motion (in this instance a snap action), is produced as a result of operator depression of a key mechanism. The key mechanism includes; a resilient member or striker, pivotally supported intermediate its ends, a means for displacing one end of the resilient member, a means for restraining the other end of the resilient member in response to partial displacement of the one end thereby accumulating energy within the resilient member and selectively releasing the restrained end upon further displacement of the one end. Thus, resulting in a snap motion by the end that was restrained due to the sudden release of energy.

More specifically, in the arrangements herein disclosed each key mechanism is provided with an elongated spring striker having one end in the path of movement of a depressable keylever. The striker is supported for pivotal movement upon a fulcrum. The forward, (ie., closest to the keyboard) end of the striker is coupled to the keylever providing biased support thereof, while the rearward end is operable by a restraining means. The restraining means in each embodiment is different, however they all function to provide the same result; that is, to momentarily hold one end of the striker thereby storing energy therein. Further depression of the keylever suddenly removes the restraint causing the striker to snap or flick in an upward motion. The keylever is supported by the striker so that after being released the keylever is returned to its rest position. A desirable resulting feature of the present key mechanism arrangement is the opposition to further keylever depression is suddenly removed. This is felt by the typist and functions to indicate sufficient depression of the keylever for operation.

A keyboard includes a multiplicity of such key mechanisms the number of which depends upon the particular application. Actuation of the striker by key depression is utilizable by a suitable utilization apparatus. In other words, the snap action, through appropriate circuitry or mechanical mechanism, can be used to convey key selection information usable by the machine or equipment with which the keyboard is employed. Several such suitable utilization apparatus are disclosed herein for use in connection with the present invention.

Accordingly, it is an object of the present invention to provide a key mechanism arrangement which has a snap action output operation.

It is also an object of the present invention to provide an economical key mechanism arrangement which is simple to assemble requiring a minimal number of components, modular construction and requires only simple adjustments.

Another object of the present invention is to provide a key mechanism arrangement including a keylever and a striker which are coupled together without the use of any additional parts.

It is also an object of the present invention to provide a key mechanism arrangement which imparts a "tactile touch" felt by the operator.

Still another object of the present invention is to provide a key mechanism arrangement in a keyboard and whose output can be applied to a variety of devices.

A further object of the present invention is to provide a key mechanism which is relatively free of maintenance having long life and ease of repair.

Other objects and many of the attendant advantages of this invention will be readily appreciated as the same becomes better understood by reference to the following detailed description when considered in connection with the accompanying drawings.

BRIEF DESCRIPTION OF THE DRAWING

FIG. 1 is a perspective view, partly in section, of a first embodiment of the key mechanism arrangement according to the present invention within the keyboard for operative cooperation with a utilization apparatus.

FIG. 2 is a sectional left side elevation along section A—A of FIG. 1 showing the key mechanism arrangement in relation to a member of the utilization apparatus.

FIG. 3 is a view similar to that of FIG. 2 showing a keylever depressed to a position just prior to activation.

FIG. 4 is a view similar to that of FIG. 3 showing the keylever at a fully depressed position.

FIG. 6 is a perspective view similar to that of FIG. 1 showing a second embodiment of the key mechanism arrangement according to the present invention for operative cooperation with a mechanical utilization apparatus.

DETAILED DESCRIPTION OF THE PREFERRED EMBODIMENTS

Figures 5, 7:
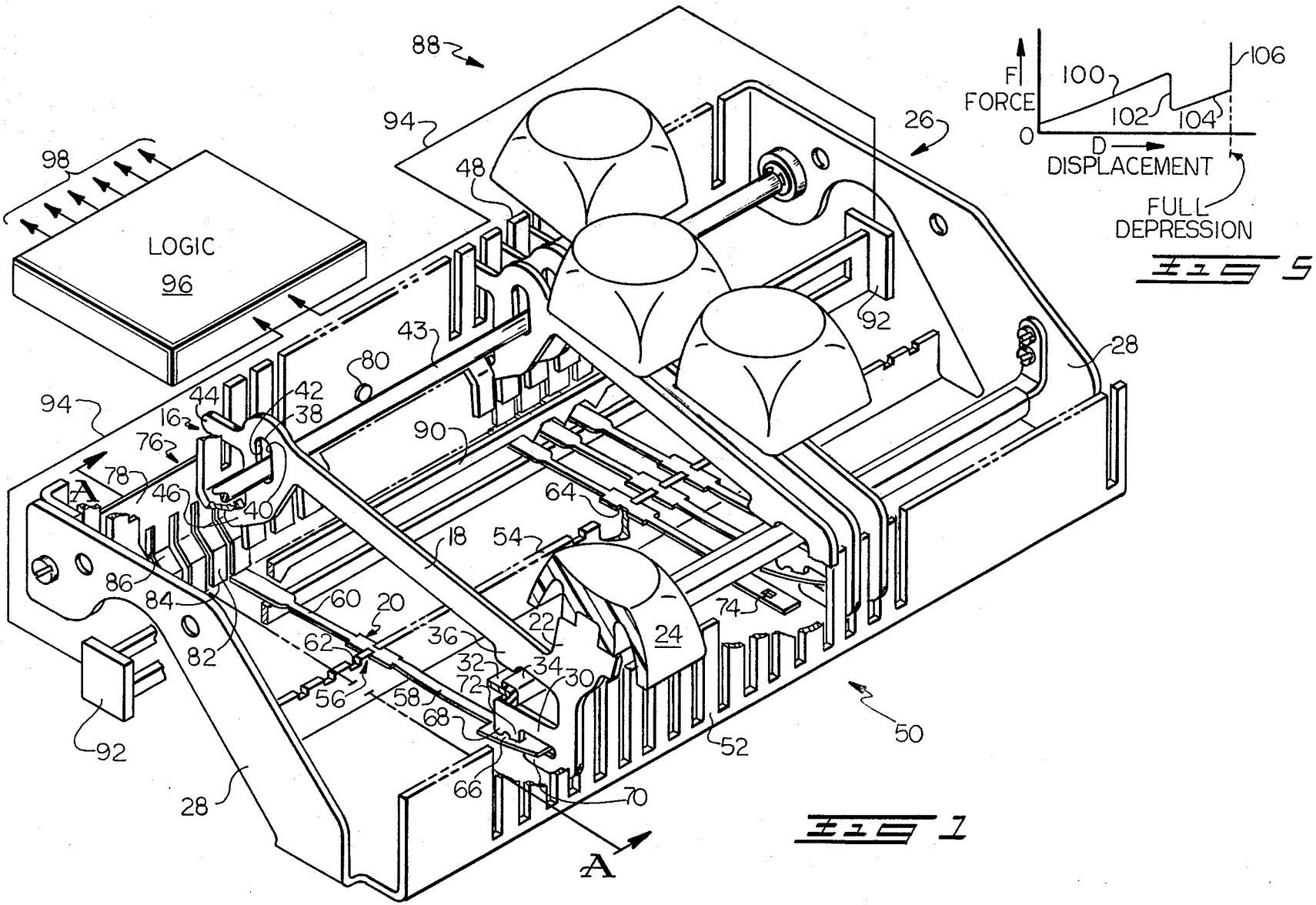
FIG. 5 is a graph illustrating the relationship between the force opposing keylever depression and displacement of the keylever.
FIG. 7 is a sectional left side elevation along section B—B of FIG. 6 showing the key mechanism arrangement for activation of a selected typebar through a power roll.

It should initially be pointed out that the teachings of the present key mechanism arrangement may be used in a wide variety of business machines or equipment having operation input initiated by a keyboard. Four preferred embodiments of key mechanism arrangements are disclosed in the drawings and described in detail below. Any of the disclosed embodiments may be used in connection with any suitable aforesaid business machine.

DESCRIPTION OF EMBODIMENT OF FIGS. 1-4

The first embodiment of the present invention includes a key mechanism arrangement 16 as illustrated in FIGS. 1-4. Referring now particularly to FIG. 1, the key mechanism arrangement 16 includes a keylever 18 supported by a resilient member or striker 20. A lug 22 extends upwardly from the keylever 18 for support of a finger-engageable keybutton 24. Generally, in keyboards as in keyboard 26, there are provided a multiplicity of key mechanisms each includes a keylever 18 which are in a laterally spaced arrangement. Each of the keylevers 18 used in keyboard 26 has a similar profile, however lug 22 may be positioned along the keylever 18 to correspond with the different row arrangements according to the type of keyboard 26 used in connection with a particular business machine. For purposes of understanding this disclosure, keyboard 26 is used in connection with an electric typewriter. The keyboard 26 preferably is of a modular construction for ease of assembly having all key mechanism arrangements 16 assembled between frames 28, which in turn may be adaptable for securing to main frames (not shown) of the typewriter.

The keylever 18 has a rearwardly extending arm 30 that is biased as described below, to engage a lower surface of a stop member 32 and in so doing defines a rest position for the keylever 18. Stop member 32 is fixedly mounted between frames 28 for operation with all keylevers 18. A pad 34 constructed of resilient material may be provided on stop member 32 for noise reduction. The keylever 18 is depressably mounted for movement from its rest position to a fully depressed position which is shown in FIG. 4. A downstanding projection 36 on the keylever 18 is aligned for abutment with stop member 32 for limiting depression, when keylever 18 is fully depressed. The amount of downward displacement required for all keylevers 18 is the same regardless of row location, therefore size and position of downstanding projection 36 are the same for all keylevers 18.

The keylever 18 is provided with a vertical slot 38 formed by vertical edges 40 and 42. A cylindrical rod 43, rigidly secured between frames 28, freely passes through slot 38 to slidingly engage edges 40 and 42. The edges 40 and 42 function as camming surfaces for limited control of keylever 18 movement. The keylever 18 further includes a pair of rearwardly extending fingers 44 and 46 that extend freely through slots of a rigidly secured rear comb member 48 for vertical guidance and stability of the rear portion of the keylever 18 during its motion.

The striker 20 is for biasly supporting the keylever 18 and restoring the keylever 18 from its fully depressed position by having the striker 20 coupled to the keylever 18 in a manner described later. The striker 20 is preferably an elongated leaf, constructed from a resilient spring steel material. However, a resilient plastic material would equally satisfy the material requirements for the striker 20. A U-shaped support structure 50, carried by frames 28, provides torsional strength to the modular construction of the keyboard 26. A forwardmost arm 52 of U-shaped structure 50 is slotted, and has therein a portion of extending arm 30 of the keylever 18, thus providing a vertical guide for stabilization of the front portion of the keylever 18. A rearwardmost arm 54 of U-shaped structure 50 includes a fulcrum 56 carried along its top edge for pivotally supporting the striker 20 intermediate its ends 58 and 60. The end 58 of striker 20 extends forwardly from fulcrum 56 for engagement with extending arm 30 of keylever 18. The other end 60 of striker 20 extends rearwardly from fulcrum 56 and is free. Fulcrum 56 includes a shallow recess 62 along the top edge of rearwardmost arm 54. There is provided at least one recess 62 for each striker 20. The striker 20 has a pair of opposed notches 64 located thereon intermediate the ends 58 and 60 adaptable for insertion within recess 62 for pivotally supporting the striker 20 upon fulcrum 56. The notches 64, when placed within recess 62, locate striker 20 with respect to limiting its fore and aft movement. Thus any compressional forces applied substantially perpendicular to striker 20 will cause compressional flexure of the striker 20 between where the force is applied and the fulcrum 56.

Referring now to FIG. 2, which illustrates the key mechanism arrangement 16 at rest, the striker 20 is shown having an end 66 terminating in the path of movement of keylever 18. The extending arm 30 of keylever 18 is provided with a contour structure thereon for engageably coupling, in a pinching fashion, with the forward end 66 of striker 20. The contour structure includes a first abutment 68 that extends downwardly from the rearmost portion of extending arm 30 for contacting the top surface of end 66. A second abutment 70 is spaced forward from and extends in an opposite direction to the first abutment 68 for contacting the bottom surface of end 66. The two abutments, 68 and 70 extend an amount to overlap, so that end 66 is defectably pinched when engageably coupled therebetween. The engagement coupling assembly of end 66 to keylever 18 provides an upwardly bias effect that is applied to the keylever 18 for support of the keylever 18, thereby urging it toward rest position against stop member 32. The contour structure on extending arm 30 also includes a downstanding finger 72 proximate abutment 68 which extends an amount beyond that of abutment 68. The end 66 is provided with a rectangular aperture 74 (shown in FIG. 1), adapted to closely receive finger 72, when keylever 18 is engageably coupled to the end 66 for assisting control movement of keylever 18. Additionally, sideways misalignment between the striker 20 and the keylever 18 is prevented thereby.

The free end 60 of striker 20 extends rearwardly for engagement with restraining means, generally denoted as 76, which includes a resilient leaf spring 78 secured to the rear comb member 48 in cantilever fashion by screw means 80. Leaf spring 78 has a plurality of flexible projections or fingers 82 which extend toward and terminate at tip 84, proximate the end 60 of striker 20. The end 60 will abut the tip 84 of flexible projection 82 when the opposite end 58 of striker 20 is depressed. The leaf spring 78 is mounted in the rear portion of keyboard 26, just behind the bottom finger 46 carried by keylever 18. A forwardly angular projection, in the form of off-set 86, is along flexible projection 82 and extends to rest in the vertical depressional path of finger 46. Angular off-set 86 functions as a camming surface for sliding engagement with finger 46 during keylever 18 displacement and to cause projection 82 to bend rearwardly during depression of the keylever 18.

A utilization apparatus 88 is provided, remote from keyboard 26, for sensing the selection of one of the key mechanism arrangements 16 resulting in a mechanical motion. The purpose of apparatus 88 is to convey information relating to which keylever 18 has been depressed, and provide a corresponding representative output. The utilization apparatus 88, for this embodiment is best shown in FIG. 1 and includes an elongated member 90 located substantially perpendicular to and spaced from a point along end 60 of striker 20. Member 90 extends transverse to keyboard 26 and is cooperable for receiving an impact blow, as a result of the mechanical motion, from each of the strikers 20 at different positions therealong. Member 90 is capable of transmitting diverging sound waves induced therein as a result of the impact blow. Apparatus 88 further includes transducing means 92 operatively connected to each end of member 90 for receiving and converting sound waves into a corresponding electrical pulse generated from each transducing means 92. A time interval exists between the arrival times of each one of the pulses caused by a single impact blow, since the distance each divergent sound wave must travel toward its respective transducing means 92 is different. A line 94 connects each of the transducing means 92 to a logic means 96. The logic means 96 is provided with circuitry capable of sensing the arrival of each electrical pulse and measuring the difference in time each pulse arrives. A display or output 98, from logic means 96 is provided for presentation of a code representative of the time measurement differential. The code at 98 is suitable for functional operation of remote devices (not shown).

FIGS. 2 to 4 represent successive motion steps of the key mechanism arrangement 16 during keylever 18 depression. For completeness, FIG. 2 shows the key mechanism arrangement 16 at rest position as in FIG. 1.

FIG. 3 illustrates the position of the keylever 18 just prior to completion of initial depression. During such movement striker 20 is caused to pivotally flex about fulcrum 56 due to the coupling engagement with the keylever 18. The rearwardly extending end 60 of striker 20 is also flexed because of its restrained abutting relationship with the tip 84 of finger 82. In so doing, end 60 is restrained from further pivotal movement as end 58 continues to be carried by the keylever 18. With end 60 fixed, the lateral restriction of the striker 20, preventing relative sliding lost motion between striker 20 and fulcrum 56 during depression of the keylever 18, end 58 is caused to progressively deflect therealong between fulcrum 56 and where the end 60 is engageably coupled to the extending arm 30 of the keylever 18. The deflection of end 58 is S-shaped and is responsible for accumulating energy within the striker 20 as long as end 60 is restrained. The accumulation of energy also increasingly opposes the depressional movement of the keylever 18. Finger 46, carried by the keylever 18, has been displaced to a level just contacting angular off-set 86 of finger 82, so that further depression of the keylever 18 will cause the finger 82 to bend rearwardly.

FIG. 4 shows the keylever 18 at its fully depressed position whereat downstanding projection 36 is against stop member 32. It can be seen that, the end 60 of striker 20 has been released from engagement with the tip 84 of finger 82. In being so released, just prior to keylever 18 arrival to its fully depressed position, rear finger 46 slidingly engages the angular off-set 86 causing the finger 82 to bend rearwardly. The amount of movement by the finger 82 is sufficient to remove the tip 84 from engagement with end 60. The resulting imparting mechanical motion by the end 60 in response to being released from engagement is a snap action or flicking motion in a clockwise direction about fulcrum 56 caused by the sudden release of the accumulated energy within striker 20.

As mentioned, the member 90 of utilization apparatus 88 is located in the rotational path of the end 60, therefore as a result of the snapping motion, member 90 receives an impact blow from the striker 20 end 60. The intensity of such a blow is sufficient to induce sound waves within member 90 which are transmitted therealong in diverse directions toward each of the transducing means 92 for conversion into electrical pulses. Each electrical pulse generated from each of the transducing means 92 is fed along its respective line 94 toward the logic means 96 for identification by well known circuitry to determine the time interval between pulses. This measurement value corresponds to the location along member 90 at which the sound waves originated. A suitable code representation appears at logic output 98 and is indicative of the selected key mechanism 16. This coded output is usable for example, to properly position a print element.

Upon release of pressure by the typist from the keybutton 24, striker 20 pivots in a counterclockwise direction about fulcrum 56 due to being upwardly biased and carries with it coupled keylever 18. During the restoring motion of the keylever 18, the finger 46 carried by keylever 18 slides upwardly against angular off-set 86 on finger 82, thus permitting resilient leaf spring 78 to return to its normal relaxed position whereat tip 84 is positioned just above the end 60 of striker 20.

DESCRIPTION OF "TACTILE TOUCH"

A desirable feature which results from the particular arrangement of parts for all of the disclosed embodiments of the present key mechanism arrangement is that it provides a "tactile touch" sensed by the operator without the addition of parts. FIG. 5 is a graph illustrating the relationship between the force opposing depression of the keylever and the displacement distance of the keylever during its depression. The profile characteristics shown in FIG. 5 are common for all embodiments described in this application. In FIG. 5 "D" denotes displacement distance traveled by the keylever 18 and "F" denotes force resisting such depression during movement from rest position (zero displacement), to full depressed position. Tests have shown for the key mechanism arrangement 16, a certain minimum force must be applied to the keylever 18 to move it away from rest poistion. This minimal force is equal to the bias force applied to the keylever 18 by the striker 20. For this reason, the graph begins at the left above "O" which indicates the pretensional load on the keylever 18. As the keylever 18 is moved from rest, the force required for continual movement increases at a substantially linear rate as shown by an upward slope 100 which peaks at approximately two-thirds of the total displacement distance. Downward slope 102 represents the opposing force to keylever 18 displacement dropping off quite rapidly. This occurs when the end 60 of striker 20 is removed from restraining engagement with the tip 84 of finger 82 and end 60 snaps upward into contact against member 90 whereupon the opposing force "F" increases once again, as illustrated by upward inclined slope 104. This sudden fall off of force "F", slope 102, provides the "tactile touch" felt by the operator which enables the operator to "feel" that the keylever 18 has been depressed a sufficient amount to accomplish the desired function. Once the keylever 18 arrives at full depression, whereat downstanding projection 36 is in abutting relationship against stop member 32, the corresponding reacting force "F" will vary with respect to pressure intensity exerted by the operator. A slope line 106 represents a reacting force "F" when the movement of the keylever 18 is positively limited.

DESCRIPTION OF EMBODIMENT OF FIGS. 6 & 7

In a second embodiment of the invention, shown in FIGS. 6 & 7, a key mechanism arrangement 116 has a mode of operation similar to the key mechanism arrangement 16 of FIGS. 1–4. Additionally, many parts and part structures appearing and described in the key mechanism arrangement of FIGS. 1–4 are similar to those described below, therefore descriptive emphasis is placed upon design differences.

Referring now particularly to FIG. 6, the key mechanism arrangement 116 of modular keyboard 126 includes a keylever 118 having a single rear finger 146 extending through the slots of a comb member 148 for vertical guidance and stability of the rear portion of keylever 118 during motion.

Restraining means 176 includes a bellcrank 177 proximate each keylever 118, pivotally mounted on a cylindrical rod 143. Bellcrank 177 has a leg 178 extending downwardly from its pivot toward engagement with a rearwardly extending free end 160 of a striker 120. The end 160 is provided with an elongated aperture 161 for placement therein of a toe 179 located at the lowermost leg 178 to prevent sideways misalignment therebetween. A coil tension spring 180 has one end connected along the leg 178 and its other end connected to an arm 154 of a U-shaped support member 150 for urging the bellcrank 177 in a counterclockwise direction about rod 143. The counterclockwise rotation of bellcrank 177 is limited by a forward edge 181 of toe 179 contacting a forward edge 182 of aperture 161. A heel 183 extends forwardly from edge 181 of toe 179 and functions as a latch means for restraining the movement of the end 160 of the striker 120.

The bellcrank 177 further includes a forwardly extending arm 184 having a pair of formed ears 185 and 186 projecting toward the keylever 118 for operatively connecting the bellcrank 177 to the keylever 118 for response to keylever 118 movement. Ear 186 projects beneath the keylever 118, so that keylever 118 contacts ear 186 upon depression thereby pivoting the bellcrank 177 rearward against the pull of coil tension spring 180. The ear 185 projects above the keylever 118 and is provided for restoring the bellcrank 177 from its pivoted position toward rest due to return motion of the keylever 118 from its fully depressed position.

Referring to FIG. 7, a mechanical utilization apparatus 188 employed for use in connection with the key mechanism arrangement 116 comprises a mechanical combination of parts to activate a printing stroke of a typebar 189. The combination of parts extends from an actuating means or pawl 190 to the typebar 189 and is similar to those disclosed in U.S. Pat. No. 3,915,277, entitled TYPING MACHINE KEY ACTION, granted October 28, 1975 and having the same assignee as the present application, and therefore only briefly described below.

The utilization apparatus 188 is powered by a continually rotating power roll 191 for actuating the typebar 189 through the combination of parts. An actuating lever 192 is pivotally mounted on a shaft 193. The pawl 190 is pivotally carried by the lever 192 and includes an engaging tooth 194 for driving engagement with the power roll 191. A return spring 195 has one end connected to the lever 192 and its other end hooked to a fixed segment bracket 196 for urging lever 192 clockwise against a main frame 197. A typebar link 198 connects the lever 192 to the typebar 189 for transmitting the driving motion from the lever 192 to the typebar 189. The typebar 189 is pivotally supported on a shaft 199 in a segment 200 and is shown in rest position against a typerest 201.

In operation, the key mechanism arrangement 116 starts with initial depression of the keylever 118 which causes the striker 120 to pivotally flex about fulcrum 156. The end 158 of striker 120 is carried by the keylever 118 while the other end 160 is restrained from movement due to the top surface of end 160 engaging the heel 183 of bellcrank 177. As the keylever 118 continues to be depressed, the end 158 deflects, thereby accumulating energy within striker 120. The depression level of the keylever 118 at which keylever 118 engages ear 186 can be approximately one-half the total travel of the keylever 118. Further depression of the keylever 118 will cause the bellcrank 177 to pivot clockwise about rod 143 thus stretching the spring 180. The resulting imparting mechanical motion by the end 160 in response to being released from engagement is a snap action motion in a clockwise direction about fulcrum 156 due to the sudden release of energy stored within striker 120. Pawl 190 receives an impact blow from the end 160 which pivots the pawl 190 into driving engagement with the power roll 191.

The snap action provided by the key mechanism 116 is most desirable in connection with the above mentioned mechanical utilization apparatus 188. The pawl 190 is caused to quickly engage the power roll 191 without chattering against teeth on the power roll 191. Once the pawl 190 is placed into driving engagement with the counterclockwise rotating power roll 191, the pawl 190 is locked to the actuating lever 192 for rotating the lever 192 counterclockwise about shaft 193. The connecting link 198 between the lever 192 and typebar 189 is pulled forward causing the typebar 189 to pivot about its shaft 199 in a normal printing motion.

DESCRIPTION OF EMBODIMENT OF FIGS. 8 & 9

Figure 8:
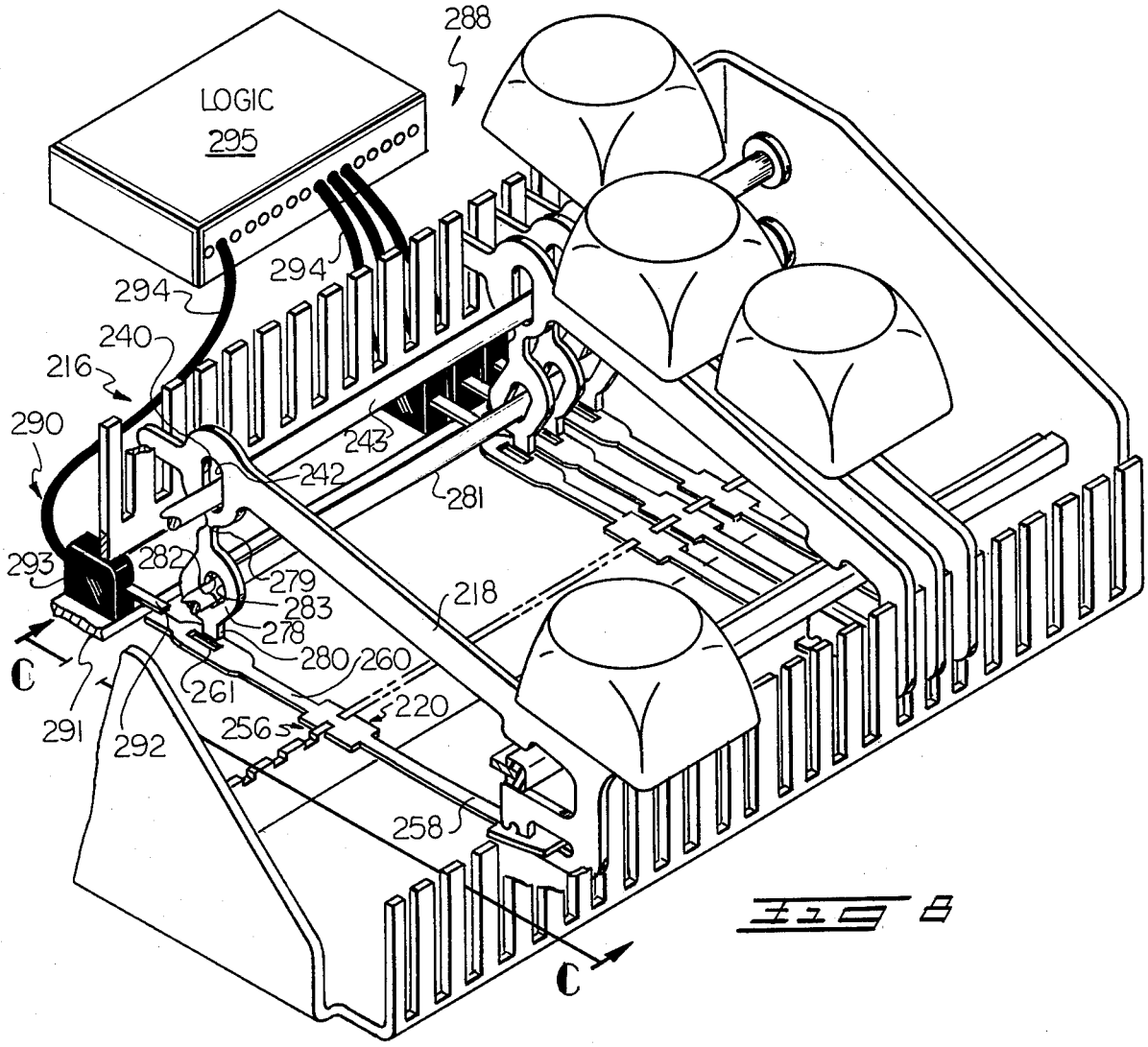
FIG. 8 is a perspective view similar to that of FIG. 1 showing a third embodiment of the key mechanism arrangement according to the present invention for operative cooperation with another utilization apparatus.
Figure 9:
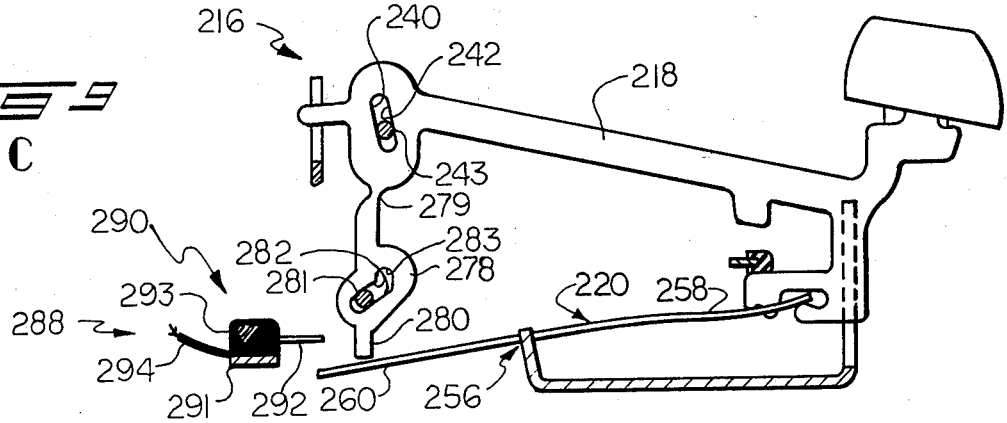
FIG. 9 is a sectional left side elevation along section C—C of FIG. 8 showing the key mechanism arrangement in relation to an output switch of the utilization apparatus.

A third embodiment of the invention is shown in FIGS. 8 and 9 wherein a key mechanism arrangement 216 includes an integral combination of a keylever structure 218 joined to a downwardly directed extension 278 by a flexible hinge 279. The integral combination is a unitary molded structure which is formed from any suitable plastic material having resilient characteristics. An abutment 280 is located at the lowermost tip of extension 278 and is aligned for restraining engagement with an end 260 of a striker 220 when the end 260 is caused to pivot about a fulcrum support 256 due to depression of the keylever structure 218. An elongated rectangular aperture 261 is provided along end 260 for permitting free insertion therein of the abutment 280. A fixed cylindrical rod 281, similar in construction to rod 243, controls and limits the movement of the extension 278. Stationary rod 281 freely engages camming side edges 282 of an elongated slot 283 within extension 278. Slot 283 is positioned at an incline of approximately 45° beginning at its forward end and extending downwardly therefrom. At rest, the rod 281 is located near the lower rearwardmost end of slot 283. Obviously, any downward force applied to the extension 278 will cause a sliding engagement between the rod 281 and the camming edges 282 along the incline, thus pivoting extension 278 rearwardly about flexible hinge 279.

In operation, initial depression of the keylever structure 218, which carries end 258 of striker 220, pivots the striker 220 about its support fulcrum 256. The other end 260 of striker 220 then engages abutment 280, thereby restraining movement of the end 260 as end 258 continues to be moved. In so doing, the end 258 is caused to deflect thereby accumulating energy within striker 220 which opposes depression of the keylever structure 218. The depressional movement of the keylever structure 218 is in a substantially vertical path which is controlled first at the rearward portion of keylever 218 by rod 243 operative against a pair of camming edges 240 and 242 on the keylever structure 218, and secondly at the forward portion of the keylever structure 218 by the engageable coupling arrangement between keylever structure 218 and the end 258 of striker 220. During depression of the keylever structure 218, the extension 278 pivots rearwardly about the hinge 279 due to the downward pressure against rod 281 by one of the side edges 282 of the elongated slot 283. Further keylever structure 218 depression causes the extension 278 to be displaced rearward an amount sufficient to vertically align the abutment 280 with the aperture 261 in end 260. At this point the end 260 is quickly released from restraining engagement with the abutment 280, thereby causing end 260 to snap in a clockwise direction about fulcrum 256 as a result of the sudden release of the energy within striker 220.

For this embodiment another suitable utilization apparatus 288 is provided for receiving an impact blow from the end 260 in response to keylever structure 218 depression. Utilization apparatus 288 includes a plurality of micro-switches 290 secured upon a cross member 291 of a machine. Each micro-switch 290 has an actuator arm 292 which when deflected operates an internal pair of contacts within the switch housing 293. A line 294 containing signal carrying wires extends from each switch 290 connected at its other end with a logic device 295. Upon the sudden snap action of the end 260, arm 292 deflects operating the internal contacts thereby activating switch 290 and the activation thereof is sensed by logic means 295. Such operational arrangements are well known in the typewriter art.

DESCRIPTION OF EMBODIMENT OF FIGS. 10 & 11

Figure 10:
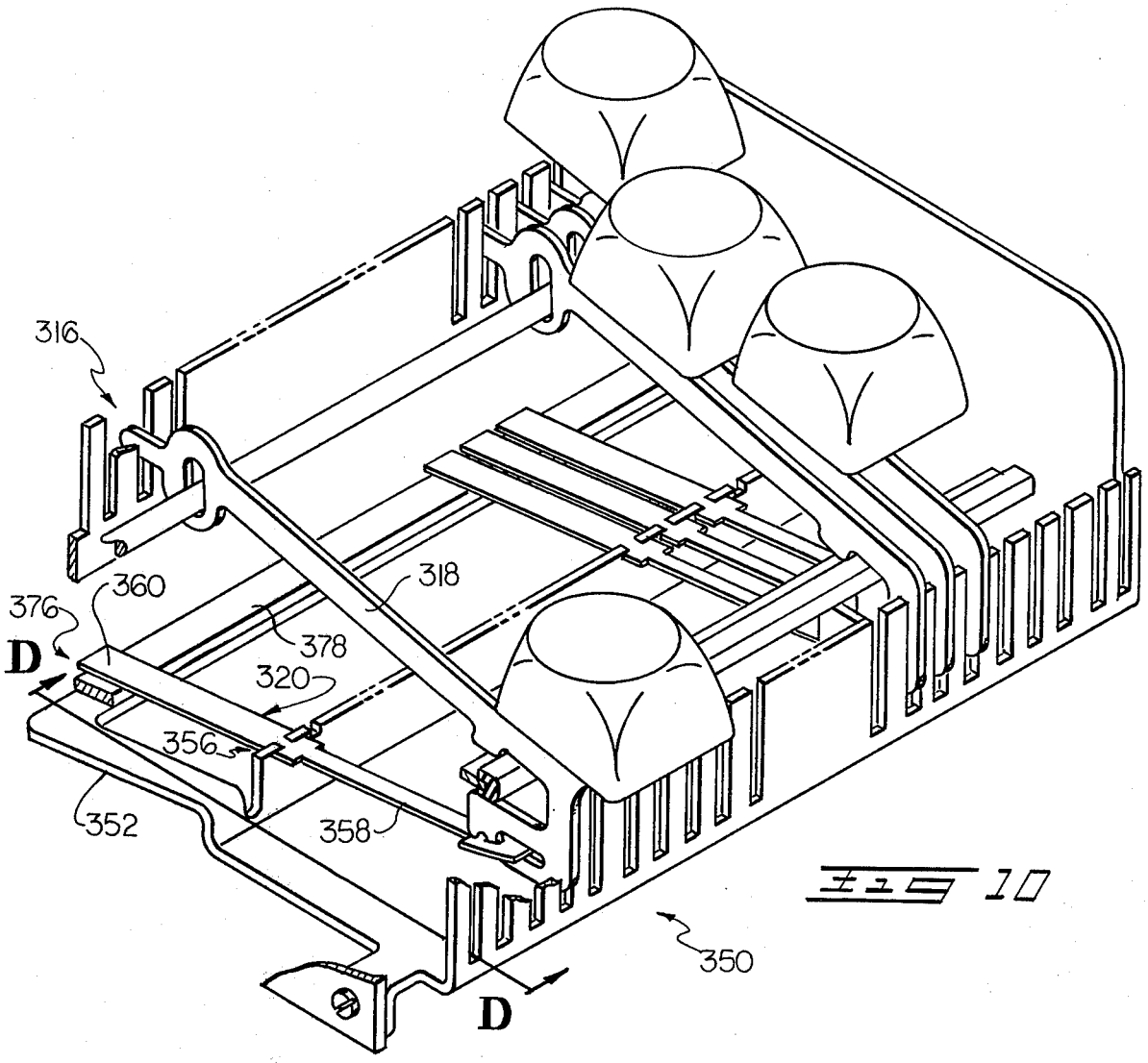
FIG. 10 is a perspective view similar to that of FIG. 1 showing a fourth embodiment of the key mechanism arrangement according to the present invention.
Figure 11:
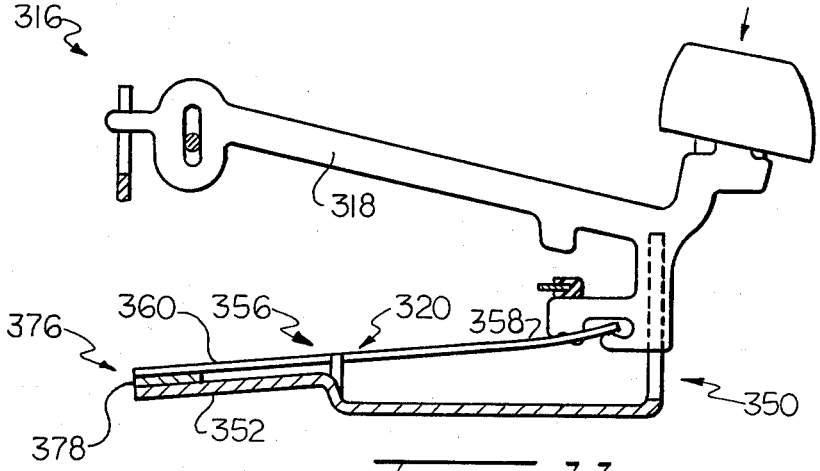
FIG. 11 is a sectional left side elevation along section D—D of FIG. 10 showing the key mechanism arrangement.

In a fourth embodiment of the invention shown in FIGS. 10 and 11 a key mechanism arrangement 316 includes an end 360 of a striker 320 which abuts bar 378 when keylever 318 is at its rest position. A restraining means 376 includes the bar 378 which is of a permanent magnetic material which functions to hold the end 360 of striker 320. The bar magnet 378 extends to traverse all of the key mechanism arrangments 316 by being secured to a rearwardmost end 352 of a U-shaped support member 350. The free end 360 of striker 320, for this embodiment, must include magnetizable material that is attracted by the magnetic pulling force of the bar magnet 378.

Upon initial actuation of the key mechanism arrangement 316, downward motion of the keylever 318 is opposed by the resilience of striker 320 and the restraining force applied to the end 360 of striker 320 by the bar magnet 378. The other end 358 of striker 320 is carried with the keylever 318 as it is depressed, thereby deflecting the end 358 between fulcrum support 356 and where end 358 is engageably coupled to the keylever 318. Once the keylever 318 has been depressed to a level approximately two-thirds its total travel, the build up of accumulated energy within striker 320 is sufficient to overcome the holding force of the bar magnet 378. As a result, the end 360 of striker 320 snaps upward in a clockwise direction about fulcrum 356. Apparatus for receiving an impact blow from end 360, due to the snap action, has been omitted from this embodiment. It is to be understood that any one of the three previously mentioned suitable forms of utilization apparatus, 88, 188 or 288 may be used in connection with the embodiment of FIGS. 10 and 11.

From the foregoing it is apparent that a keyboard having the key mechanisms arranged according to the teachings of the present invention may be used in a wide variety of business machines that are operational by either mechanical devices or electrical components. It is further apparent that, the total number of key mechanisms employed for use in the keyboard is unrestricted. Additionally, the keyboard construction includes few parts, namely, the keylever, striker and restraining means, enabling economical manufacture and assembly.

The striker assembly wherein, the method of attaching the striker to the keylever for operative movement therewith has the economical advantage of not including costly additional screws, rivets, or studs, all of which add to part inventory as well as assembly time. Additionally, such an assembly provides, a biased support of the keylever, resistance to keylever depression which when suddenly released produces a most desirable "tactile touch" felt by the operator.

As described hereinabove, the means by which the striker is restrained from movement during initial depression of the keylever vary in construction, however they all operate in the same fashion. Each of the restraining means have the advantage of simplicity without sacrifice of function which extends the life and provides for a less bulky mechanism, thus permitting a keyboard that is reliable and light weight.

It will be understood that various changes in the details, materials and arrangements of parts which have been herein described and illustrated in order to explain the nature of the invention may be made by those skilled in the art within the principle and scope of the invention as expressed in the appended claims.

What is claimed is:

1. A striker assembly for striking a selected member disposed proximate thereto, which assembly comprises:
- a resilient elongated striker member having a free end and an actuation end;
- means supporting said striker member intermediate said free end and said actuation end;
- means for displacing said actuation end of said striker member for flexure about said supporting means; and
- an element independent of said striker member for restraining movement of said free end of said striker member during a partial displacement of said actuation end, said element releasing said free end during a final displacement of said actuation end causing said free end to strike said selected member.

2. The striker assembly according to claim 1 wherein said means for displacing is a keylever.

3. The striker assembly according to claim 2 wherein said keylever is coupled to said actuation end of said striker member and is supported thereby.

4. The striker assembly according to claim 3 wherein said keylever is moveably mounted between a pair of frames, said keylever includes at least one guide surface thereon and means fixedly mounted on said frames for slidingly engaging said one guide surface to control the directional movement of said keylever.

5. The striker assembly according to claim 1 wherein at least said free end of said striker member includes a magnetizable material and said element is a magnet.

6. The striker assembly according to claim 5 wherein said striker member is a flat spring made of metal.

7. The striker assembly according to claim 6 wherein said supporting means includes:
- a pair of frames;
- a U-shaped member mounted on said frames traversing said striker assembly; and
- a fulcrum formed on said U-shaped member for pivotally supporting said striker member.

8. The striker assembly according to claim 7 wherein said fulcrum includes a recess formed in said U-shaped member and said striker member having a neck portion formed by a pair of opposed notches, said neck portion seated in said recess for pivotal movement and for preventing lateral sliding movement relative to said U-shaped member.

9. The striker assembly according to claim 1 wherein said striker member is an elongated metallic spring.

10. The striker assembly according to claim 1 wherein said supporting means includes a U-shaped member having a portion in the form of a fulcrum for pivotally supporting said striker member intermediate said one end and said free end.

11. The striker assembly according to claim 10 wherein said fulcrum includes a recess formed in said U-shaped member, and said striker member having a neck portion formed by a pair of opposed notches, said neck portion seated in said recess for pivotal movement preventing lateral sliding movement relative to said U-shaped member.

12. The striker assembly according to claim 1 further comprising:

said displacing means is a keylever operable in a depressional path;

a pair of spaced frames having said keylever depressably mounted therebetween;

a stop member rigidly fixed on said frames, said stop member located in the depressional path of said keylever;

a first abutment on said keylever for limiting depression of said keylever at a fully depressed position whereat said first abutment engages said stop member;

a second abutment on said keylever; and biasing means connected to said keylever for upwardly urging said keylever from said fully depressed position toward a rest position whereat said second abutment engages said stop member.

13. The striker assembly according to claim 12 wherein said biasing means is said striker member.

14. The striker assembly according to claim 12 further comprising:

a pair of camming surfaces on said keylever; and means mounted on said frames slidingly engaging at least one of said camming surfaces for controlling the directional movement of said keylever.

15. The striker assembly according to claim 1 wherein said actuation end and said free end are opposing extreme ends of said striker member; said striker member is pivotally mounted upon said support means; and said free end includes material responsive to a magnet.

16. The striker assembly according to claim 15 wherein said element is a magnet, said magnet having magnetic forces to attract and engageably hold said free end for preventing movement thereof during initial displacement of said actuation end, and upon further displacement of said actuation end, said free end overcomes said magnetic force thereby imparting a snap movement to said free end.

17. The striker assembly according to claim 1 wherein said final displacement of said actuation end causes a displacement of said free end in an opposite direction from said actuation end.

18. The striker assembly according to claim 1 wherein said actuation end and said free end are extreme ends of said elongated striker member.

19. The striker assembly according to claim 1 wherein said striker member is an elongated plastic spring.

20. The striker assembly according to claim 1 wherein said element is a latch for engagement by said free end of said striker member during said partial displacement of said actuation end and upon engagement between said latch and said free end, said latch restrains movement of said free end, and means operable by said displacing means for releasing said latch from engagement with said free end during said final displacement of said actuation end.

21. The striker assembly according to claim 20 wherein said latch is a finger formed from a flexible material, said finger being aligned and extending towards engagement with said free end for restraining movement of said free end during said partial displacement of said actuation end.

22. The striker assembly according to claim 21 wherein said finger has a cam surface formed thereon, said displacing means is a keylever, and said operable means is a projection integrally formed from said keylever, said projection extends towards engagement with said cam surface, said cam surface being slidingly engaged by said projection during said final displacement of said actuation end causing said finger to deflect thereby removing said finger from restraining engagement with said free end.

23. The striker assembly according to claim 20 wherein said support means includes a pair of spaced apart frames and a rod spanning said frames, said displacing means is a depressable keylever mounted on said rod, said latch is a bellcrank pivotally mounted on said rod proximal said keylever, and a spring for biasing said bellcrank towards engagement with said free end of said striker member, said bellcrank is engaged by said free end for restraining movement of said free end during said partial displacement of said actuation end.

24. The striker assembly according to claim 23 wherein said operable means includes a connection means formed on said bellcrank and operable by said keylever, said bellcrank is pivoted through said connection means in response to depression of said keylever, said connection means pivots said bellcrank against the urging of said spring an amount sufficient for releasing said free end from restraining engagement with said bellcrank during said final displacement of said actuation end.

25. The striker assembly according to claim 24 wherein said free end of said striker member has an elongated aperture therethrough, said bellcrank has a leg for engaging said free end, said leg has a lug extending through said aperture for preventing side ways misalignment between said bellcrank and said striker, said leg being moved with said connection means on said bellcrank into alignment with said aperture for freely receiving said leg when said bellcrank is caused to pivot against the urging of said spring.

26. The striker assembly according to claim 20 wherein said support means includes a pair of spaced apart frames, said displacing means is a depressable keylever mounted between said frames, said latch includes said keylever constructed from a flexible plastic material, and an extension integrally formed from said keylever, an abutment on said extension extends towards engagement with said free end, and a bar mounted on said frames slidingly engages said extension to align said abutment for engagement with said free end of said striker member, said abutment is engaged by said free end for restraining movement of said free end during said partial displacement of said acutation end.

27. The striker assembly according to claim 26 wherein said extension has a slot having edges defining a cam surface slidingly engaged with said bar, said cam surface slidingly engaging said bar moves said extension causing said abutment to be removed from engagement with said free end of said striker member during said final displacement of said actuation end.

28. The striker assembly according to claim 1 wherein said displacing means is a keylever operable from a rest position to a depressed position, and structure means on said keylever for coupling said actuation end of said striker member to said keylever for deflecting said striker member to form an S-shape between said structure means and said supporting means for tensioning said free end of said striker member in response to depression of said keylever and in response to said element preventing movement of said free end of said striker member.

29. The striker assembly according to claim 28 wherein said striker member has a top surface and a bottom surface and said structure means includes a first abutment on said keylever in engagement with said top surface of said striker member located at a first point spaced relative from said supporting means and said structure means includes a second abutment on said keylever in engagement with said bottom surface of said striker member located at a second point spaced further away from said supporting means than said first point for forming said S-shaped deflection of said striker member in response to depression of said keylever.

30. The striker assembly according to claim 29 wherein said first abutment extends downwardly from said keylever and said second abutment extends upwardly from said keylever, said first and second abutments have an overlapping relationship for pinching said free end to tension said striker member for biasing said keylever from said depressed position toward said rest position and for holding said keylever at said rest position.

31. The striker assembly according to claim 28 wherein at least said free end of said striker member includes a magnetizable material and said element is a magnet.

32. A key mechanism in a keyboard having a keylever mounted between frames and operable in a depressional path, the key mechanism comprising:

a resilient member having one end in the depressional path of said keylever and a free end;

means supporting said resilient member intermediate said one end and said free end; and an element independent of and cooperable with said resilient member for restraining movement of said free end during initial depressional movement of said keylever causing said resilient member to deflect about said supporting means accumulating energy within said resilient member, said element releasing said free end upon further depression of said keylever causing said free end to move in a direction opposite from said depressional movement of said keylever in response to release of said energy.

33. The key mechanism according to claim 32 wherein said resilient member is an elongated plastic spring.

34. The key mechanism according to claim 32 wherein said element is a latch engaged by said free end of said resilient member for restraining movement of said free end during said initial depression of said keylever; and means cooperable with said latch for releasing said free end from engagement with said latch upon said further depression of said keylever.

35. The key mechanism according to claim 34 wherein said latch is a flexible finger mounted in cantilever fashion on said frames, said flexible finger being aligned and extending towards engagement with said free end for restraining movement of said free end when said finger is engaged by said free end during said initial depression of said keylever.

36. The key mechanism according to claim 35 wherein said flexible finger is a resilient leaf spring.

37. The key mechanism according to claim 35 wherein said means for releasing includes a projection integrally formed from said keylever, said projection extends toward engagement with said finger, and said flexible finger has a cam surface formed thereon, said cam surface being slidingly engaged by said projection upon said further depression of said keylever causing said flexible finger to deflect thereby removing said finger from engagement with said free end.

38. The key mechanism according to claim 34 wherein said first frames support a rod, said latch is a bellcrank having a leg, said bellcrank being pivotally mounted on said rod proximal said keylever, said leg aligned and extending towards engagement with said free end, and spring means for biasing said leg of said bellcrank towards engagement with said free end of said resilient member, said leg is engaged by said free end for restraining movement of said free end during said initial depression of said keylever.

39. The key mechanism according to claim 38 wherein said means for releasing includes a connection means formed on said bellcrank and operable by said keylever, said bellcrank is caused to pivot about said rod when said connection means is contacted by said keylever during said initial depression of said keylever, and said connection means moves said leg against the urging of said spring means an amount sufficient to remove said leg from restraining engagement with said free end during said further depression of said keylever.

40. The key mechanism according to claim 39 wherein said free end has an elongated aperture therethrough and said leg has a lug extending through said aperture for preventing side ways misalignment therebetween, said leg being moved with said connection means into alignment with said aperture for freely receiving said leg when said bellcrank is caused to pivot against the urging of said spring means.

41. The key mechanism according to claim 34 wherein said latch includes said keylever constructed from a flexible plastic material, and an extension integrally formed from said keylever is connected thereto by a hinge, an abutment on said extension extends toward engagement with said free end, a bar mounted on said frames slidingly engages said extension to align said abutment for engagement with said free end, said abutment is engaged by said free end for restraining movement of said free end during said initial depression of said keylever.

42. The key mechanism according to claim 41 wherein said means for releasing includes a slot through said extension, said slot defining a cam surface slidingly engaged with said bar, said cam surface slidingly engaging said bar moves said extension causing said abutment to be removed from engagement with said free end during said further depression of said keylever.

43. The key mechanism according to claim 42 wherein said free end has an elongated aperture therethrough, said aperture freely receives said abutment when said abutment is placed into alignment with said aperture.

44. The key mechanism according to claim 32 wherein said resilient member is a flat spring pivotally mounted upon said support means intermediate said one end and said free end, and structure means on said keylever for coupling said one end of said flat spring to said keylever for deflecting said flat spring to form an S-shape between said structure means and said supporting means for tensioning said free end of said flat spring in response to said initial depressional movement of said keylever and in response to said element restraining movement of said free end of said flat spring.

45. The key mechanism according to claim 44 wherein said flat spring has a top and a bottom surface and said structure means includes a first abutment on said keylever in engagement with said top surface of said flat spring located at a first point spaced relative from said supporting means, and said structure means further includes a second abutment on said keylever in engagement with said bottom surface of said flat spring located at a second point spaced further away from said supporting means than said first point for forming said S-shaped deflection of said flat spring in response to said initial depressional movement of said keylever.

46. The key mechanism according to claim 45 wherein said first and second abutments on said keylever are misaligned front to rear permitting said abutments to have an overlapping relationship for pinching said one end to tension said flat spring for upwardly biased support of said keylever.

47. The key mechanism according to claim 46 further comprises a stop means mounted on said frames and cooperable with said biased keylever for limiting upward travel thereof to define a rest position for said keylever.

48. The key mechanism according to claim 47 wherein said structure means further includes a projection on said keylever and said flat spring has an aperture near said one end, said aperture closely receives said projection to prevent side way misalignment between said keylever and said flat spring.

49. The key mechanism according to claim 32 wherein at least said free end of said resilient member includes a magnetizable material and said element is a magnet.

50. The key mechanism according to claim 32 wherein said resilient member is a elongated metallic spring.

51. A keylever assembly for biasly supporting a keylever, which assembly comprises:

a frame means;

an elongated resilient flat spring pivotally supported intermediate its ends on said frame means, said flat spring has a top and a bottom surface; and structure means on the keylever for engageably coupling the keylever with one end of said flat spring, said structure means includes a first abutment on the keylever extending in a first direction for engagement with said top surface near said one end of said flat spring and a second abutment on the keylever extending in a second direction opposite said first direction for engagement with said bottom surface near said one end of said flat spring, said first and second abutments being horizontally misaligned and vertically overlapping for engageably coupling the keylever with said one end of said flat spring, said one end being flexed when coupled between said first and second abutments causing said one end to be pretensioned for biasly supporting the keylever.

52. The assembly according to claim 51 further comprises a stop means of said frame means cooperable with said biased keylever for limiting upward travel thereof to define a rest position for the keylever.

53. The assembly according to claim 52 wherein said structure means further includes a projection on the keylever and said flat spring has an aperture near said one end, said aperture closely receives said projection to prevent side way misalignment between the keylever and said flat spring.

* * * * *